US008146172B2

(12) United States Patent
Geiwald

(10) Patent No.: US 8,146,172 B2
(45) Date of Patent: Apr. 3, 2012

(54) METHOD FOR CREATING GARMENT CUFFS WITH STRETCH AND RECOVERY CHARACTERISTICS

(75) Inventor: Paul Urban Geiwald, San Diego, CA (US)

(73) Assignee: Winds Enterprises, Inc., Del Mar, CA (US)

( * ) Notice: Subject to any disclaimer, the term of this patent is extended or adjusted under 35 U.S.C. 154(b) by 217 days.

(21) Appl. No.: 12/469,663

(22) Filed: May 20, 2009

(65) Prior Publication Data

US 2010/0294814 A1 Nov. 25, 2010

(51) Int. Cl.
*A41B 7/00* (2006.01)

(52) U.S. Cl. ..... 2/123; 2/60

(58) Field of Classification Search ..... 2/169, 76, 2/227, 275, 162, 59, 60, 123, 69; 66/172 R, 66/172 E See application file for complete search history.

(56) References Cited

U.S. PATENT DOCUMENTS 3,168,749 A * 2/1965 Cala ..... 2/269
4,090,897 A * 5/1978 Minick ..... 156/73.1
4,364,785 A 12/1982 Wajs et al.
4,496,407 A 1/1985 Lowery, Sr. et al.
4,534,819 A 8/1985 Payet et al.
4,560,427 A 12/1985 Flood
4,645,629 A 2/1987 Stern
4,693,771 A 9/1987 Payet et al.
4,879,155 A 11/1989 Fujisawa
5,061,331 A 10/1991 Gute
5,085,917 A 2/1992 Hodnett, III
5,447,589 A 9/1995 DeLangis
5,586,339 A * 12/1996 Lathan ..... 2/46
5,601,547 A * 2/1997 Kato et al. ..... 604/385.3
5,624,735 A 4/1997 Anderson et al.
5,948,028 A 9/1999 Raad et al.
6,192,717 B1 * 2/2001 Rabinowicz ..... 66/177
6,286,144 B1 * 9/2001 Henderson et al. ..... 2/69
6,517,651 B2 * 2/2003 Azulay ..... 156/73.1
6,618,860 B1 9/2003 Sullivan et al.
6,622,312 B2 * 9/2003 Rabinowicz ..... 2/401
6,630,043 B2 10/2003 Sloot
6,743,322 B2 6/2004 Sloot
6,769,358 B2 8/2004 Jordan (Continued)

OTHER PUBLICATIONS

International Search Report for PCT/US2010/035680, Jul. 21, 2010, 7 pages.

*Primary Examiner* — Danny Worrell

(74) *Attorney, Agent, or Firm* — Christie, Parker & Hale, LLP

(57) ABSTRACT

A method for creating garment cuffs includes applying a high-polymer heat-sealable material on a cuff area of the fabric used for the garment. The heat-sealable material and the fabric underneath are then cut with an ultrasonic cutter to form the cuff and concurrently finish the lower edges of the cuff. The heat-sealable material has properties that allow it to stretch from an equilibrium point in response to tension applied on the material, and recover back towards the equilibrium point in response to release of the tension on the material. Reinforcing the cuff area with the heat-sealable material allows the cuff area to maintain its stretch and recovery properties even after the fabric has degraded after extended use and washing of the fabric. Furthermore, the ultrasonic cutting causes some of the heat-sealable film to melt into the cut edges of the fabric at the cuff to create substantially sealed edges at the cuff.

18 Claims, 4 Drawing Sheets

U.S. PATENT DOCUMENTS

| | | | | |
|---|---|---|---|---|
| 6,797,352 | B2 | 9/2004 | Fowler | |
| 6,817,037 | B1 | 11/2004 | King | |
| 7,191,720 | B2 * | 3/2007 | Thomas | 112/475.09 |
| 7,228,809 | B2 | 6/2007 | Angelino et al. | |
| 7,927,441 | B2 * | 4/2011 | Lau | 156/73.3 |
| 2002/0151239 | A1 | 10/2002 | Aerts | |
| 2005/0170151 | A1 | 8/2005 | Dobson et al. | |
| 2007/0161307 | A1 | 7/2007 | Dobson et al. | |
| 2007/0243360 | A1 | 10/2007 | Morton | |
| 2009/0047481 | A1 | 2/2009 | Welsch et al. | |
| 2009/0094729 | A1 | 4/2009 | Lin et al. | |

* cited by examiner

METHOD FOR CREATING GARMENT CUFFS WITH STRETCH AND RECOVERY CHARACTERISTICS

FIELD OF THE INVENTION

The present disclosure generally relates to cuff constructions for garments, and in particular to methods for constructing cuffs that with stretch and recovery characteristics, and improved sealing at the edge of the cuffs.

BACKGROUND

Cuffs are well known in the art of clothing manufacture. Almost every article of clothing has a cuff of some sort at an opening through which a person's limbs (arms or legs), or neck is extended. Cuffs may be made by rolling outward the material at the sleeve, leg, or neck and sometimes, pressing or stitching them in place. A separate band of material may also be sewn at a lower edge of a sleeve to create the cuff. One of the main functions of a cuff is to seal the clothing around the limb or neck of the wearer.

Hemming is also well known in the art of clothing manufacture. Hemming is a common way to treat an edge of a garment at the opening through which a person's limb or neck is extended in order to prevent fraying of the fabric at the edge. To hem a piece of fabric, a garment worker folds up a cut edge, folds it up again, and then sews it down. The process of hemming thus completely encloses the cut edge of the fabric, so that it cannot ravel or fray. A hem is also referred to as the edge of cloth treated in this manner.

One of the aims of athletic and compression garments is to provide a tight fit or compression on all or portions of a wearer's body, such as, for example, at the cuffs. Compression at the cuffs locks them in place and provides muscle support at those locations. Other types of garments also benefit from a tight fit at the cuff, such as, for example, to keep the garments in place, retain heat, or keep debris out. Accordingly, it is desirable for the cuffs of athletic and compression garments to stretch to receive a limb or neck of the wearer, and then recover from the stretched position to provide a tight fit at the cuff. Although the fabric used for compression and other athletic garments do generally provide such characteristics, at least initially, they lose their recovery properties over time as the wearer continues to stretch the garment on and off the body. Thus, it is desirable to reinforce the cuff areas of a garment with a material that will allow the cuff areas to stretch and then recover to maintain the tight fit even with use over time. The material that is used should not be bulky or uncomfortable to the wearer.

It is also desirable to finish the edges of the garment at the cuff, without use of thread. Use of traditional sewing using threads to hem the garment at the cuff often restricts the amount of stretching that may be required in those areas to receive the limb or neck of the wearer. Using "four needle" flat lock stitching overcomes some of the stretch issues that arise due to the use of thread, but there is a limit to how far the stitching can be pulled. Sometimes the threads can pop if stretched too far. Furthermore, for many high performance athletic and compression garments, there is a lot of tension placed on the thread with wear of the garment, and over time, the threads will fail.

SUMMARY OF THE INVENTION

According to one embodiment, the present disclosure is directed to a method for constructing a cuff of a garment where the garment is formed via one or more fabric panels with edges defining openings of the garment. Each of the openings receives a body part of a wearer. The method includes positioning a heat-sealable material with stretch and recovery properties on the one or more fabric panels near the edges defining the openings of the garment. The method further includes heat-sealing the material onto the one or more fabric panels near the edges thereby creating the cuff. The heat-sealable material is configured to stretch to receive a first portion of a body part and recover from the stretched position to substantially hug a second portion of the body part at the cuff. According to one embodiment, the first portion of the body part has a first diameter, and the second portion of the body part has a second diameter smaller than the first diameter.

According to one embodiment of the disclosure, an ultrasonic cutter is used to cut a portion of the heat-sealed material together with a portion of the one or more fabric panels that have been heat-sealed to the material. The cutting melts at least a portion of the heat-sealed material onto second edges of the fabric generated by the cutting to create substantially sealed second edges. The substantially sealed second edges form the lower edges of the cuff. According to one embodiment, the substantially sealed second edges minimizes fraying of fabric at the lower edges of the cuff.

According to one embodiment, the edges of the fabric near which the heat-sealable material is positioned and heat-sealed are unfinished edges, and the cutting via the ultrasonic cutter creates the substantially sealed second edges that are finished edges.

According to one embodiment, the fabric is made of elastic textile material with stretch and recovery properties, wherein the stretch and recovery properties of the heat-sealable material are at least equal to the stretch and recovery properties of the fabric at an initial wear of the garment. According to one embodiment, at least the recovery properties of the fabric degrades at a quicker rate than the recovery properties of the heat-sealable material.

According to one embodiment, the material is heat-sealed to an exterior of the garment for visibly defining the cuff.

A person of skill in the art should appreciate that the various embodiments of the present disclosure helps provide cuffs on garments that maintain their stretch and recovery properties even with extended wear and washing of the garments. Furthermore, the various embodiments of the present disclosure help to avoid the need to finish the fabric at the edges of the cuff by folding over the fabric and sewing the edges to create a hem. The eliminating of sewn-on hems at the cuffs eliminates the restriction imposed by such threads on the stretching that can be achieved in those locations to receive a person's head or limbs.

These and other features, aspects and advantages of the present disclosure will be more fully understood when considered with respect to the following detailed description, appended claims, and accompanying drawings. Of course, the actual scope of the disclosure is defined by the appended claims.

DETAILED DESCRIPTION

In general terms, various embodiments of the present disclosure are directed to methods for constructing cuffs for a garment, such as, for example, compression or athletic garments, where the cuffs retain their stretch and recovery characteristics despite their use over time. The cuffs are constructed with finished edges without the need the traditional hemming. The finish of the edges according to the embodiments of the present disclosure provides improved sealing of the fabric at the edges to minimize fraying over time.

According to one embodiment of the disclosure, a high-polymer heat-sealable material is applied on a cuff area on an outer or inner surface of the fabric used for the garment. The heat-sealable material and the fabric underneath are then cut with an ultrasonic cutter to form the cuff and concurrently finish the lower edges of the cuff. The heat-sealable material has properties that allow it to stretch from an equilibrium point in response to tension applied on the material, and recover back towards the equilibrium point in response to release of at least some of the tension on the material. For example, the material might stretch to receive a first portion of a body part (e.g. a head, fist, or foot), and then recover to hug a second portion of the body part with a smaller diameter (e.g. a neck, wrist, or ankle). The heat-sealable material has properties that make it more durable than the underlying fabric, allowing the material to retain its stretch and recovery properties longer than the underlying fabric. Thus, reinforcing the cuff area with the heat-sealable material allows the cuff area to maintain its stretch and recovery properties even after the fabric has degraded after extended use and washing of the fabric. Specifically with reference to the recovery property of the heat-sealable material, such recovery property allows the cuff to hug the limb or neck of the wearer to provide a tight fit at the cuff.

According to one embodiment of the disclosure, the ultrasonic cutting causes some of the heat-sealable film to melt into the cut edges of the fabric on the cuff to create substantially sealed edges at the cuff. According to one embodiment of the disclosure, the sealing of the fabric at the edge that is created is better than the sealing that would result from the use of the ultrasonic cutter to cut the fabric without the application of the heat-sealed film. The improved sealing of the edge reduces the fraying that can occur over time. Thus, the use of ultrasonic cutters according to the embodiments of the present disclosure allow simultaneous cutting and sealing/finishing of the edges that do not require further treatment such as hemming or other finishing applications.

Figure 1:
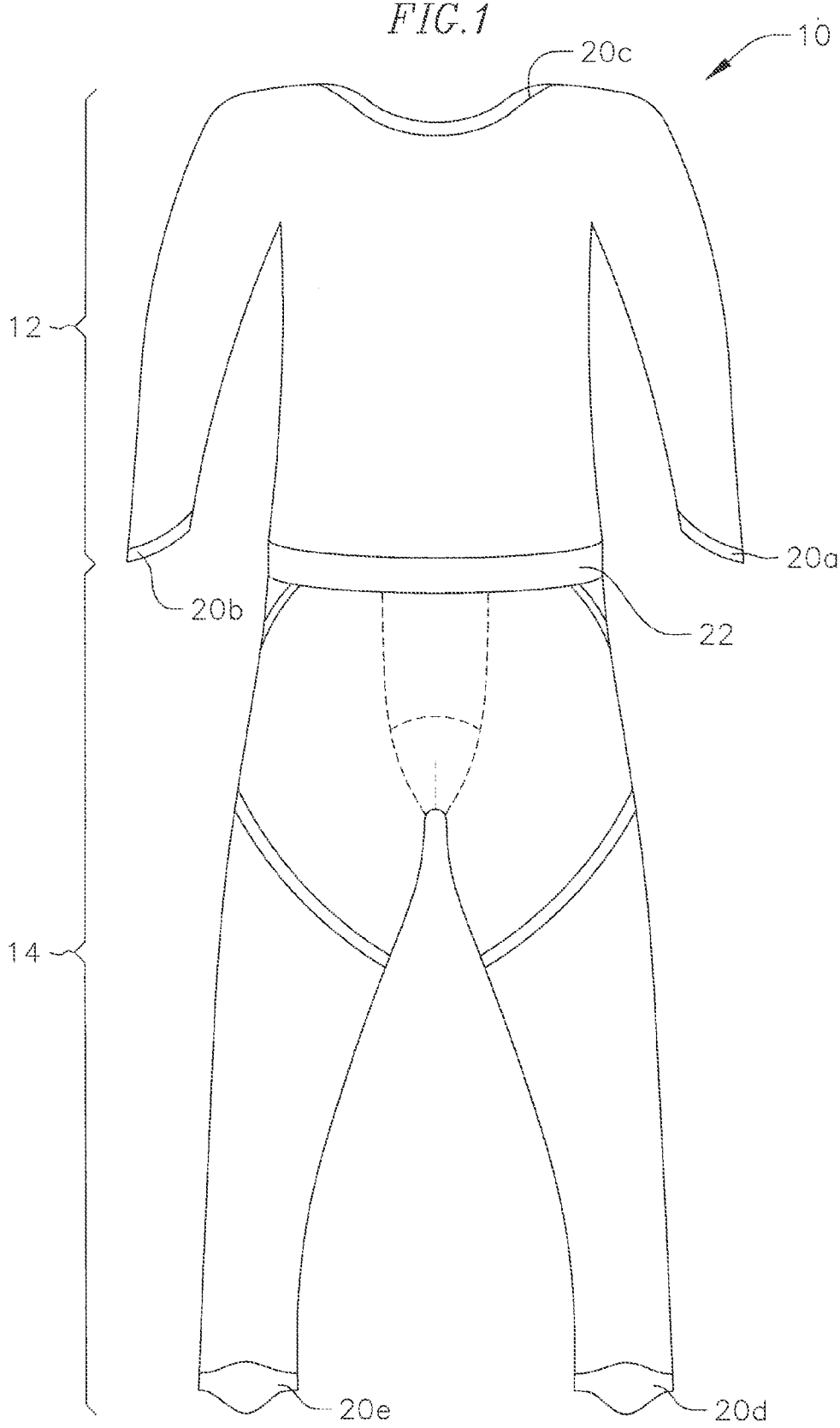
FIG. 1 is a front perspective view of a garment constructed in accordance with the teachings of the present disclosure.

FIG. 1 shows a garment 10 with cuffs 20*a*-20*e* (collectively referred to as 20) constructed in accordance with the teachings of the present disclosure. The garment 10 may be a shirt 12 and/or pants 14, and may be single or separate pieces. The garment 10 has various openings for receiving different body parts of a wearer of the garment. The openings are defined by cuffs 20*a*-20*e*. For example, an opening for a neck is defined by cuff 20*c*, openings for arms are defined by cuffs 20*a*-20*b*, and openings for legs are defined by cuffs 20*d*-20*e*. According to one embodiment of the disclosure, the pants 14 include a waistband 22 that receives a lower portion of a person's body. A person of skill in the art should realize that the waistband may be constructed in the same manner in which the cuffs 20 are constructed. Thus, the description herein of the construction and characteristics of the cuffs also applies to the construction and characteristics of the waistband.

The garment 10 may be a compression garment, foundation garment, high-performance athletic garment, and/or the like, that conforms well to the body of the wearer. In this regard, the garment 10 is constructed via one or more panels of fabric which may be an elastic textile material, such as, for example, a polyurethane elastic textile such as Spandex or Lycra. The fabric has stretch and recovery properties which, at least during an initial wearing and washing of the garment, allow the garment to conform well to the body of the wearer. In addition to shirts, pants, tights, and undergarment, the term garment is also used to refer to gloves, socks, caps, and other articles of clothing.

According to one embodiment of the disclosure, the cuffs 20 are created by a heat-sealable material that is heat-sealed onto the exterior or interior of the garment at or near the edges of openings configured to receive a body part of a wearer. The heat-sealable material may be a film, tape, or any other material with heat-sealing characteristics that allow the heat-sealable material to fuse to the fabric underneath when elevated temperature and elevated pressure are applied to the material. The amount of heat or pressure applied will vary depending on the specific type of heat-sealable material that is used, and/or the type of fabric to which the material is being applied. The heat-sealable material may also be referred to as a heat-seal or a heat-transfer.

According to one embodiment of the disclosure, the heat-sealable material is a high-polymer heat-sealable material that has the advantage of higher stretch and recovery than heat-sealable materials that do not contain polymers. That is, the adding of the polymers allows the heat-sealable material to stretch during the wearing or taking off of the garment as the underlying fabric is stretched to receive the wearer's neck or limb, and further allows the heat-sealable material to recover from the stretched position causing the underlying fabric to which the material is bonded, to also recover and provide a snug or tight fit around the neck or limb. The addition of polymers to the heat-sealable material, and the applying of such material to the garment to form the cuffs 20, allow the cuffs to maintain their recovery properties for a tight fit at the cuffs, even with repeated stretching of the garment 10 on and off of the body of the wearer, and repeated washing that degrades the fabric over time. The heat-sealable material disclosed in the present disclosure has longer lasting properties that does not degrade as fast as the underlying fabric. For example, the heat-sealable material disclosed in the present disclosure may last twice as long as the underlying fabric. That is, the material may retain the stretch and recovery properties twice as long. Put differently, at least the recovery properties of the fabric degrades at a quicker rate (e.g. twice as fast) than the recovery properties of the heat-sealable material.

According to one embodiment of the disclosure, the heat-sealable material has a predetermined color which, when applied onto the outside of the garment 10, helps to distinctly define the areas that constitute the cuff. The color may be selected to coordinate with any logos or designs on the exterior of the garment. Furthermore, the application of the heat-sealable material on the outside of the garment helps provide structure and tight fit of the garment at the cuffs without causing the material to grip or stick onto the wearer's skin or hair. Such gripping or sticking might sometimes cause discomfort during the wearing or taking off of the garment. Nonetheless, it might sometimes be desirable to apply the heat-sealable material on the interior of the garment in order to keep the material hidden from sight.

Regardless of whether the heat-sealable material is on the inside or outside, the cuffs 20 may be cut to provide an ergonomic shape that conforms to the curves of the body. This is an advantage over traditional cuffs that that are attached on a simple fold and thus, can generally only take the shape of a straight edge.

FIGS. 2A-2F illustrate a process for constructing cuffs 20' of a garment in accordance with the teachings of the present disclosure. The illustrated cuffs 20' have the same characteristics as the characteristics of the cuffs 20 shown in FIG. 1.

Figure 2A:
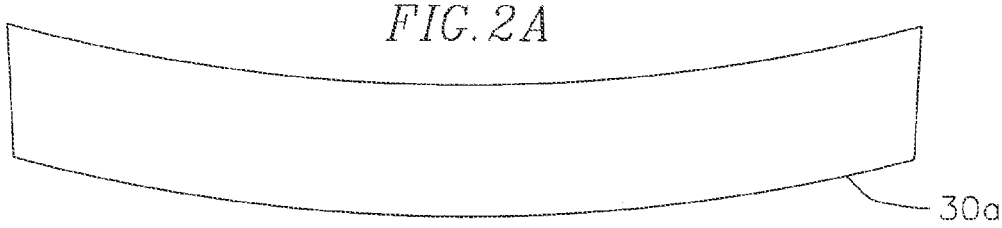
FIG. 2A is a perspective view of a heat-sealable material according to one embodiment of the disclosure.

With reference to FIG. 2A, a desired portion of the heat-sealable material is cut from, for example, a 475 mm×500 mm sheet of the available material. According to one embodiment, the film is cut with excess width (and sometimes excess length) than what will ultimately end up on the finished garment.

Figure 2B:
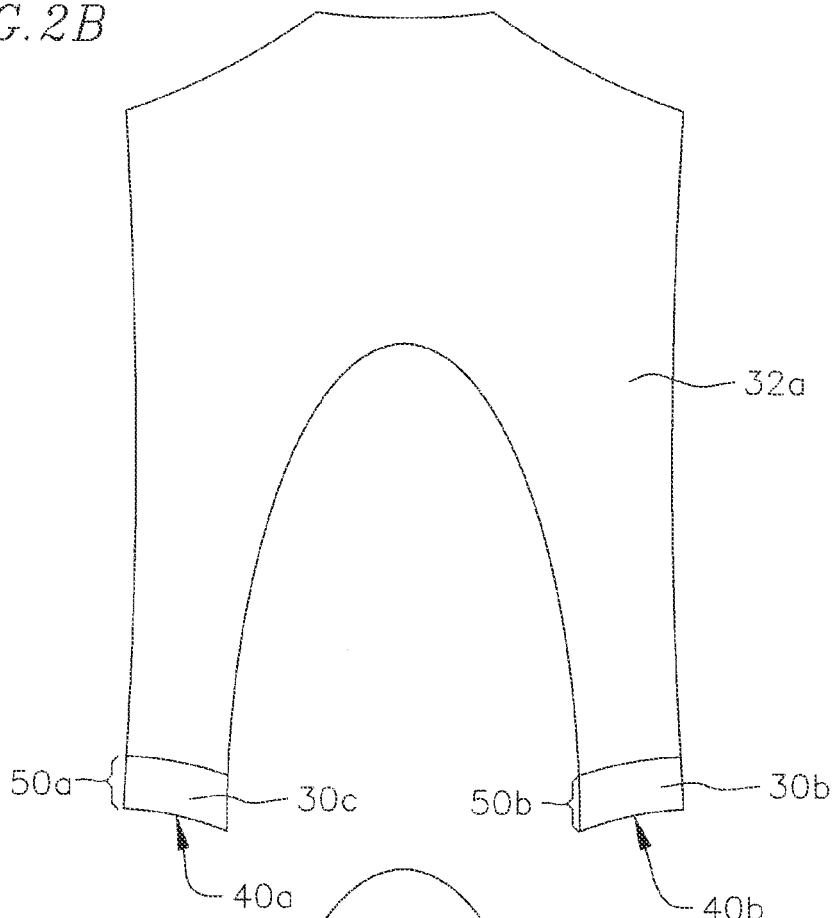
FIGS. 2B-2C are perspective views of fabric panels with the heat-sealable material of FIG. 2A placed on cuff areas of the panels according to one embodiment of the disclosure.
Figure 2C:
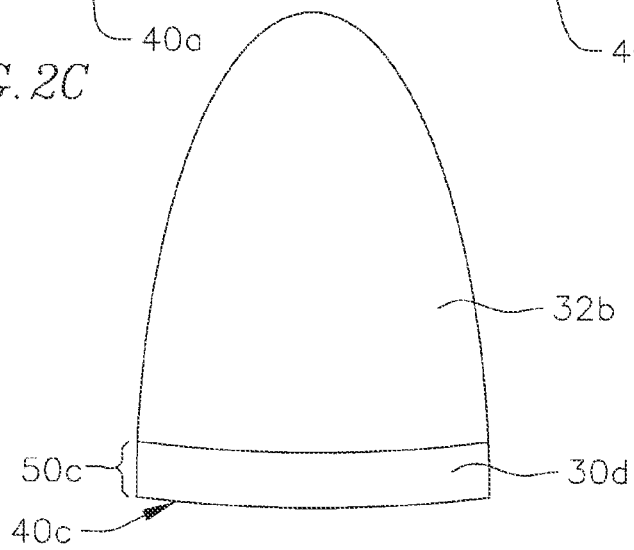

With reference to FIGS. 2B-2C, the heat-sealable material 30*b*, 30*c*, 30*d* is positioned on an exterior of fabric panels 32*a*, 32*b* used for the garment, at or near unfinished edges 40*a*-40*c* of the panel over cuff areas 50*a*-50*c*. Unfinished edges are edges with free ends of fibers that have not been treated to prevent fraying and unraveling of the fibers. According to one embodiment of the invention, the panels are cut with excess cuff areas 50*a*, 50*b* to allow the excess fabric to be cut, and the final cuff area to be shaped, at a later point in time.

The positioned material 30*b*-30*d* is cured onto the exterior of the fabric panel 32*a*, 32*b* on the cuff areas 50*a*-50*c* at or near the unfinished edges 40-40*c*. According to another embodiment of the invention, the heat-sealable material may be positioned and heat-sealed onto the interior of the fabric panels 32*a*, 32*b* instead of the exterior.

According to one embodiment of the disclosure, the material is fused onto the fabric by applying heat and pressure on the material via use of a heat transfer machine conventional in the art. The type of glues, temperatures, and pressure required varies depending on the fabric to which the material is fused. For example, for Nylon Spandex materials, the heat transfer machine is set a temperature of 320 degrees Fahrenheit, for 3-5 seconds, at 80 PSI pressure. According to one embodiment, a silicone die face is used in the heat transfer press. The heat-sealable material has a layer of heat-activated glue that flows and bonds with the fabric.

Figure 2D:
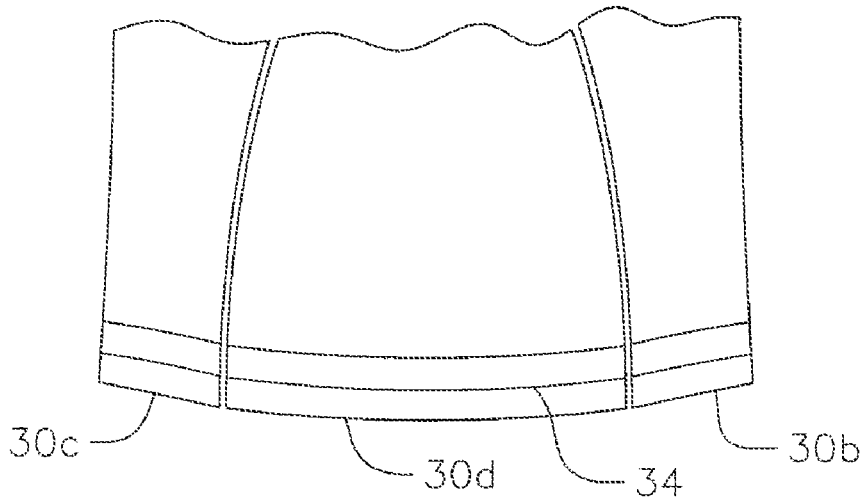
FIG. 2D is a perspective view of the fabric panels of FIGS. 2B-2C to which the heat-sealable materials have been applied, showing edges that are drawn by a garment maker for defining cuff edges of a garment according to one embodiment of the disclosure.

With reference to FIG. 2D, a manufacturer marks edges 34 of the applied heat-seal material that will form the edges of the cuff on the finished garment. The manufacturer may mark the edges in any conventional manner, via hand or via machine, to give the edges of the cuff any desired shape. According to one embodiment of the disclosure, the shape and width of the cut heat-seal material are selected to allow the material to conform to the contours of the body at the cuff.

Figure 2E:
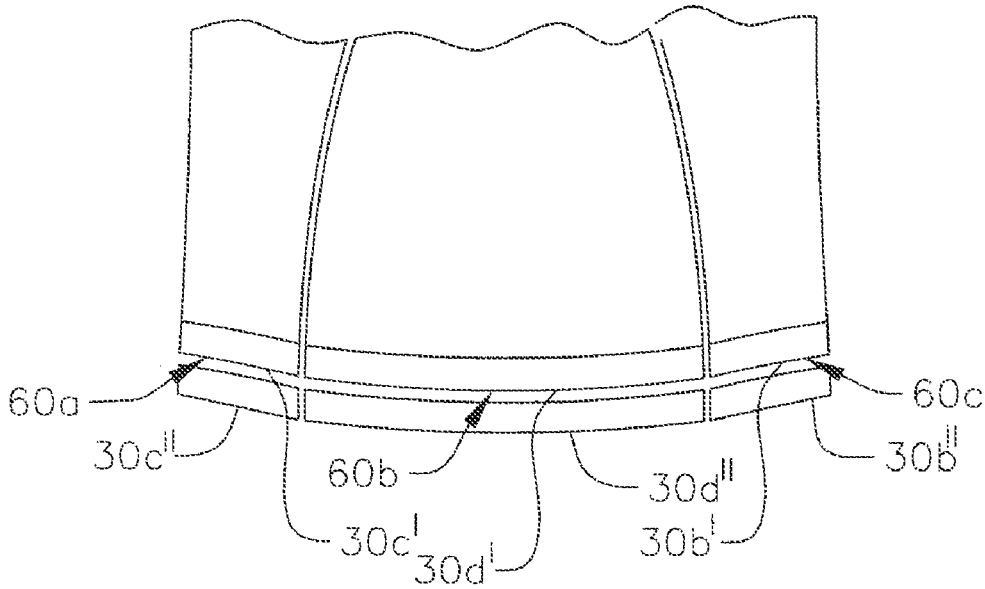
FIG. 2E is a perspective view of the fabric panels of FIG. 2D after the cuff edges have been cut along the marked edges according to one embodiment of the disclosure.

With reference to FIG. 2E, the heat-seal material 30*b*-30*d* and the fabric to which the material has been fused, are cut together along the marked edges 34 to form cuffs 30*b*', 30*c*', and 30*d*' (collectively referred to as 30'). The excess heat-seal material 30*b*", 30*c*", and 30*d*" and the excess fabric with the frayed, unfinished edges 40*a*-40*c*, are discarded.

Any of various well known cutting devices may be used for the cutting of the heat-seal material and the fabric underneath. According to one embodiment of the disclosure, the cutting is done by an ultrasonic cutter. For example, the ultrasonic cutter may be one manufactured by Branson Ultrasonics Corporation of Danbury, Conn.

Ultrasonic cutters are conventionally used to simultaneously cut and seal the material that is being cut, such as, for example, fabric. Although the created seal helps minimize fraying at the edges, fraying does occur over time. Applying the heat-sealable material onto the fabric and then cutting the heat-sealed material together with the fabric, using the ultrasonic cutter, creates a finished edge that minimizes the fraying. In this regard, the ultrasonic cutter generates heat that causes some of the heat-sealed material to melt over the cut edges of the fabric and lock-in the fabric fibers. This results in clean, finished edges 60*a*-60*c* that form the lower edges of the cuff at an opening of the garment. The lower edges 60*a*-60*c* are devoid of any hemming that would normally be used to finish a garment. The edges 60*a*-60*c* have a seal, due to the cutting of the heat-sealable material after it has been heat-sealed onto the fabric, that is greater than the sealing that would be achieved by the cutting the fabric without the heat-seal material. This results in a better finish and less fraying over time at the edges of the cuff.

Figure 2F:
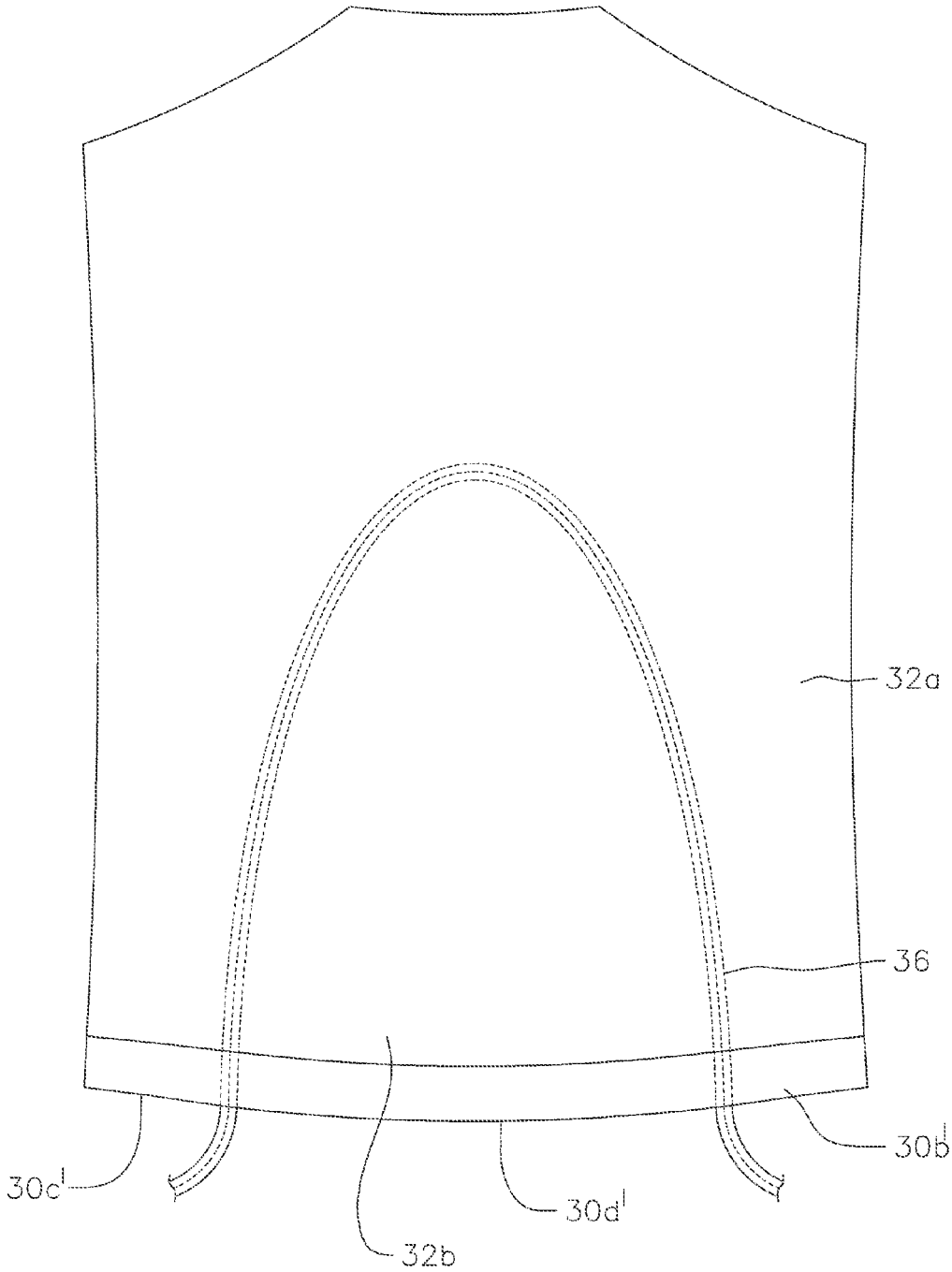
FIG. 2F is a perspective view of the fabric panels of FIG. 2E assembled and sewn together according to one embodiment of the disclosure.

With reference to FIG. 2F, the fabric panels 32*a*, 32*b* are joined together at seam 36 to make the garment. For example, the panels may be joined together so that there is an opening at the end of the cuff 30' to receive a body part of a wearer.

A person of skill in the art will appreciate that the construction of the cuffs 20, 30' according to the teachings of the disclosure avoids the need to have hems at the end of the cuffs. When cuffs are turned and sewn together using thread, this creates bulk and point of thread failure. The use of sewn hems also puts restriction on the stretching of the cuffs. The cuff that is generated according to the teachings of the present disclosure results in significantly less bulkiness due to the lack of folding of the cuff or horizontally sewn threads. This improves the stretching at the cuffs and provides increased comfort for the wear. The use of heat-sealable material for the cuffs also allows the cuffs to conform well to the body of the wearer. The user feels they are one with the garment, and it is conforming to the natural shapes of the body at the cuffs. The high-recovery heat-sealable material also functions well as the user continues to stretch the garment on and off the body repeatedly.

According to one embodiment of the disclosure, the heat-sealable material that is used to create the cuffs is composed of one or more layers of film, such as for example, four or five layers of film. A top layer may be protective layer for protecting the material from wear and tear over time, as will be understood by a person of skill in the art. According to one embodiment, the protective layer allows the heat-sealable material to last longer that the fabric underneath, without losing its stretch and recovery characteristics A second layer of film may be a pigment layer that gives the heat-sealable material a predetermined color. The pigment color may be selected to coordinate with any logos or designs on the garment. The color selected may also function to highlight or draw attention to the cuff areas of the garment, and help distinctly define the areas of the garment that constitute the cuff.

A third layer film may be a polymer layer that gives the heat-sealable material structure, as well as its stretch and recovery characteristics. According to one embodiment of the disclosure, polymers having stretch and recovery properties and used for creating the third layer film. Although the polymer layer is described as a separate layer, a person of skill in the art should recognize that polymers may be added to one or more of the other layers of the heat-sealable material in order to give the material the desired stretch and recovery properties. The amount and type of polymers may vary depending on the desired degree of stretch and recovery for the material. According to one embodiment of the disclosure, the selected polymers at least match the initial stretch and recovery properties of the underlying fabric, before the fabric starts to degrade.

The adding of the third polymer layer gives the heat-sealable material an advantage over other heat-sealable materials in that other heat-sealable materials generally do not stretch, or, even if capable of stretching to a certain extent, do not have recovery properties that allow the material and the fabric underneath, to return to their original, non-stretched position for a tight fit at the cuffs. Instead, if a traditional heat-seal were applied at the cuffs and forced to stretch, ripples would generally be formed at the cuffs. Traditional heat-seals therefore do not provide the benefit provided by the heat-sealable material according to the teachings of this disclosure, such benefit being that the heat-sealable material stretches from an equilibrium point to receive the biggest diameter of a body part inserted through the cuff (e.g. a head, fist, or foot), and recovers from the stretched position towards the equilibrium position as the diameter decreases to receive a body part with a smaller diameter (e.g. neck, wrist, or ankle) that will ultimately remain at the cuff. The tight fit around the cuff provides benefits such as muscle support, keeps the garment in place, retrains heat, and/or keeps debris out.

A fourth layer of film may be a layer of heat-activated glue that flows and bonds with the fabric when heat and pressure is applied on the film.

Although this disclosure has been described in certain specific embodiments, those skilled in the art will have no difficulty devising variations to the described embodiment which in no way depart from the scope and spirit of the present disclosure. Furthermore, to those skilled in the various arts, the disclosure itself herein will suggest solutions to other tasks and adaptations for other applications. It is the Applicant's intention to cover by claims all such uses of the disclosure and those changes and modifications which could be made to the embodiments of the disclosure herein chosen for the purpose of disclosure without departing from the spirit and scope of the disclosure. Thus, the present embodiments of the disclosure should be considered in all respects as illustrative and not restrictive, the scope of the disclosure to be indicated by the appended claims and their equivalents rather than the foregoing description.

What is claimed is:

1. A method for constructing a cuff of a garment, the garment being formed via a fabric panel with a free end defining an opening of the garment configured to receive a body part of a wearer, the method comprising:

positioning a heat-sealable material with stretch and recovery properties on the fabric panel near the free end;

heat-sealing the material onto the fabric panel near the free end, wherein the heat sealed material has an upper edge and a lower edge opposite to the upper edge, the upper edge of the heat sealed material forming an upper edge of the cuff; and substantially melting the heat-sealed material onto an edge of the fabric panel for forming a substantially sealed edge, the edge of the fabric panel being formed by cutting the heat-sealed material between the upper edge and the lower edge together with the fabric, the substantially sealed edge forming a lower edge of the cuff opposite to the upper edge of the cuff.

2. The method of claim 1, wherein the cutting is via an ultrasonic cutter, wherein the cutting melts at least a portion of the heat-sealed material onto the edge of the fabric panel.

3. The method of claim 1, wherein the substantially melting minimizes fraying of fabric at the edge of the fabric panel.

4. The method of claim 2, wherein the substantially sealed edge is a seamless, finished edge.

5. The method of claim 1, wherein the heat-sealable material is configured to stretch to receive a first portion of a body part and recover from the stretched position to substantially hug a second portion of the body part at the cuff, wherein the first portion of the body part has a first diameter, and the second portion of the body part has a second diameter smaller than the first diameter.

6. The method of claim 1, wherein the fabric is made of elastic textile material with stretch and recovery properties, wherein the stretch and recovery properties of the heat-sealable material are at least equal to the stretch and recovery properties of the fabric at an initial wear of the garment.

7. The method of claim 6, wherein at least the recovery properties of the fabric degrades at a quicker rate than the recovery properties of the heat-sealable material.

8. The method of claim 6, wherein the material is heat-sealed to an exterior of the garment for visibly defining the cuff.

9. The method of claim 1, wherein the cuff has no seams.

10. A garment having a cuff, the garment being formed via a fabric panel with a free end defining an opening of the garment configured to receive a body part of a wearer, the cuff being constructed by:

positioning a heat-sealable material with stretch and recovery properties on the fabric panel near the free end;

heat-sealing the material onto the fabric panel near the free end, wherein the heat sealed material has an upper edge and a lower edge opposite to the upper edge, the upper edge of the heat sealed material forming an upper edge of the cuff; and substantially melting the heat-sealed material onto an edge of the fabric panel for forming a substantially sealed edge, the edge of the fabric panel being formed by cutting the heat-sealed material between the upper edge and the lower edge together with the fabric, the substantially sealed edge forming a lower edge of the cuff opposite to the upper edge of the cuff.

11. The garment of claim 10, wherein the cutting is via an ultrasonic cutter, wherein the cutting melts at least a portion of the heat-sealed material onto the edge of the fabric panel.

12. The garment of claim 10, wherein the substantially melting minimizes fraying of fabric at the edge of the fabric panel.

13. The garment of claim 12, wherein the substantially sealed edge is a seamless, finished edge.

14. The garment of claim 10, wherein the heat-sealable material is configured to stretch to receive a first portion of a body part and recover from the stretched position to substantially hug a second portion of the body part at the cuff, wherein first portion of the body part has a first diameter, and the second portion of the body part has a second diameter smaller than the first diameter.

15. The garment of claim 10, wherein the fabric is made of elastic textile material with stretch and recovery properties, wherein the stretch and recovery properties of the heat-sealable material are at least equal to the stretch and recovery properties of the fabric at an initial wear of the garment.

16. The garment of claim 15, wherein at least the recovery properties of the fabric degrades at a quicker rate than the recovery properties of the heat-sealable material.

17. The garment of claim 15, wherein the material is heat-sealed to an exterior of the garment for visibly defining the cuff.

18. The garment of claim 10, wherein the cuff has no seams.

* * * * *